United States Patent [19]

Berry

[11] 4,273,807

[45] Jun. 16, 1981

[54] ACICULAR α-IRON PARTICLES AND RECORDING MEDIA EMPLOYING SAME

[75] Inventor: Kenneth L. Berry, Wilmington, Del.

[73] Assignee: E. I. Du Pont de Nemours and Company, Wilmington, Del.

[21] Appl. No.: 95,072

[22] Filed: Nov. 16, 1979

Related U.S. Application Data

[60] Division of Ser. No. 21,811, Mar. 19, 1979, Pat. No. 4,207,092, which is a continuation-in-part of Ser. No. 774,138, Mar. 3, 1977, abandoned.

[51] Int. Cl.[3] ..... B05D 5/12

[52] U.S. Cl. ..... 427/132; 75/0.5 AA; 427/128

[58] Field of Search ..... 427/128, 132; 75/0.5 BA, 0.5 AA

[56] References Cited

U.S. PATENT DOCUMENTS

| | | | |
|---|---|---|---|
| 2,879,154 | 3/1959 | Campbell | 75/34 X |
| 3,607,219 | 9/1971 | Giessen | 75/0.5 BA |
| 3,865,627 | 2/1975 | Roden et al. | 427/180 X |
| 4,017,303 | 4/1977 | Koester et al. | 75/0.5 AA |
| 4,050,962 | 9/1977 | Koester et al. | 427/127 X |

*Primary Examiner*—Bernard D. Pianalto

[57] ABSTRACT

Particulate product containing at least 75 weight % iron (total iron content) and at least 25 weight % acicular α-iron metal, process for making said product and magnetic recording medium having said product incorporated therein, said product having a length less than 1 micron (μ), a length to diameter ratio of at least about 10:1, a coercivity ($iH_c$), of greater than about 800 oersteds, a saturation magnetization ($\sigma_s$) of at least 110 electromagnetic units/gram (emu/g), a residual (remanent) magnetization ($\sigma_r$) of at least 50 emu/g, and a ratio ($\sigma_r/\sigma_s$) of residual (remanent) magnetization ($\sigma_r$) to saturation magnetization of at least about 0.45.

5 Claims, No Drawings

ACICULAR α-IRON PARTICLES AND RECORDING MEDIA EMPLOYING SAME

This is a division, of application Ser. No. 021,811, filed on Mar. 19, 1979, U.S. Pat. No. 4,207,092, which is a continuation-in-part of application Ser. No. 774,138, filed on Mar. 3, 1977, now abandoned.

DESCRIPTION

1. Technical Field

This invention relates to processes for preparing α-iron particles, the particles prepared thereby, and magnetic recording media incorporating the particles.

2. Background Art

Acicular α-iron particles, submicron in size, are recognized as potentially superior magnetic materials for use in magnetic recording media, such as magnetic tapes. Due to the inherently high magnetization of these particles, magnetic recording media incorporating the particles should be capable of having a higher output than such media incorporating other ferromagnetic particles. In order to utilize the high magnetization of acicular α-iron particles, such particles must also have a high coercivity. However, high coercivity and particle acicularity are difficult to maintain in most iron oxide reduction processes commonly used to make acicular α-iron particles. Thus, there is a need for a reduction process which provides a product having the high content of acicular α-iron particles required to impart superior magnetization characteristics to the product and, moreover, there is a need for such a process which does not adversely affect the acicularity of the particles.

U.S. Pat. No. 2,879,154 discloses microscopic, acicular, monocrystalline iron particles which are stated to be particularly suitable for the manufacture of permanent magnets. These particles are prepared by heating microscopic, acicular, anhydrous iron oxide particles to an elevated temperature below about 300° C. in an atmosphere of a reducing gas such as hydrogen at a hydrogen pressure less than 50 mm of Hg until at least about 30% of the iron oxide has been reduced to iron. In a preferred embodiment, part of the hydrogen is derived from calcium hydride which reacts with the water produced during reduction.

U.S. Pat. No. 3,607,219 discloses that iron powders for magnetic recording are made by reducing α- or γ-$Fe_2O_3$ with hydrogen at a pressure of at least 10 atmospheres and a temperature of 150°-300° C. A water-binding substance, for example, calcium oxide, at a greater than 10/1 ratio to iron oxide is employed in the reactor. The iron oxide and the calcium oxide are not dispersed, separate crucibles containing the two materials being placed one on top of the other. The nondispersion of the two materials results in a product with a low aspect ratio, deficient remanence, and coercivities of about 200-450.

U.S. Pat. No. 3,865,627 discloses a magnetic recording medium containing fine acicular ferromagnetic particles that are comprised of at least 75% metal, at least a majority of which is iron and any other metal ingredient that comprises at least 10 weight-percent of the metal being selected from cobalt, nickel and chromium; that exhibit a saturation magnetization ($\sigma_s$) of at least 75 electromagnetic units/gram; and that have an average diameter and saturation intensity of magnetization ($I_s$) no greater than certain graphically depicted limits.

U.S. Pat. Nos. 4,017,303 and 4,050,962 disclose processes for making acicular ferromagnetic metal pigments containing iron and having a reduced field strength distribution and a steeper residual magnetization curve, which materials are useful in the manufacture of magnetic recording media, said processes comprising applying an alkaline earth metal cation and an organic compound having at least one group capable of forming a chelate, or said cation and an equivalent amount of a mono-, di- or tribasic carboxylic acid of 1-6 carbon atoms, to appropriate acicular iron oxides and then reducing the treated iron oxides.

French Pat. No. 1,176,173 discloses the reduction of iron oxide by the exothermic metallurgical process according to the reaction $$Fe_3O_4+4H_2+4CaO \rightarrow 3Fe+4Ca(OH)_2.$$

The reaction is carried out at 400°-700° C. and 1-40 atmospheres pressure under autogenous conditions. The product is useful for rolling sheet iron laminates.

SUMMARY OF THE INVENTION

According to the present invention there is provided a process for preparing acicular α-iron particles comprising (1) dispersing acicular particles of α-FeOOH (goethite) intimately with CaO, the weight ratio of CaO/α-FeOOH being at least 1:1, (2) contacting the dispersion with hydrogen at a temperature in the range of about 150°-350° C. and a pressure in the range of about 1-1000 atmospheres and (3) recovering from the reaction mixture of step (2) particulate product containing at least 75 weight % iron (total iron content) and at least 25 weight % acicular α-iron metal, said product having a length less than 1 micron (μ), a length to diameter ratio of at least about 10:1, a coercivity ($iH_c$) of greater than about 800 oersteds, a saturation magnetization ($\sigma_s$) of at least 110 electromagnetic units/gram (emu/g), a residual (remanent) magnetization ($\sigma_r$) of at least 50 emu/g, and a ratio ($\sigma_r/\sigma_s$) of residual (remanent) magnetization ($\sigma_r$) to saturation magnetization of at least about 0.45.

There is also provided herein an acicular α-iron particle-containing product having the aforesaid characteristics and a magnetic recording medium in which said acicular α-iron particle-containing product is incorporated in a magnetizable layer carried on a nonmagnetizable support.

DETAILED DESCRIPTION OF THE INVENTION

The crux of the present invention lies in the hydrogen reduction of acicular particles of α-FeOOH which are intimately codispersed with calcium oxide, to form acicular α-iron particles having a coercivity greater than about 800 oersteds, preferably greater than 900 oersteds. The process of the invention comprises (1) dispersing acicular particles of α-FeOOH, preferably submicron in size with the largest dimension less than 1 micron, intimately with calcium oxide, the weight ratio of CaO/α-FeOOH being at least 1:1, preferably in the range of about 1.5-5:1, more preferably about 3-4:1, (2) contacting and reacting the dispersion with hydrogen at a temperature in the range of about 150°-350° C., preferably about 150°-250° C., and at a pressure in the range of about 1-1000 atmospheres, preferably over 400 atmospheres, more preferably in the range of about 450-550 atmospheres, and (3) recovering from the reaction mixture particulate product containing at least 75 weight % iron (total iron content) and at least 25 weight % acicular α-iron metal, said product having a length less than 1 micron (μ), a length to diameter ratio of at least 10:1, a coercivity ($iH_c$) of greater than about 800 oersteds, a saturation magnetization ($\sigma_s$) of at least 110 electromagnetic units/gram (emu/g), a residual (remanent) magnetization ($\sigma_r$) of at least 50 emu/g, and a ratio ($\sigma_r/\sigma_s$) of residual (remanent) magnetization ($\sigma_r$) to saturation magnetization of at least about 0.45.

This process provides microscopic, acicular α-iron particles which possess superior magnetic properties, particularly saturation and residual magnetizations and $\sigma_r/\sigma_s$ ratios and high coercivities ($iH_c$), making them ideal for use in coatings on magnetic recording tapes. Because these particles are acicular or needle-like in configuration, they possess greatly enhanced magnetic properties due to the phenomenon known as shape anistropy.

The microscopic, acicular α-iron particles of this invention and possessing the desired magnetic properties are made by hydrogen reduction of specially synthesized, naturally acicular α-FeOOH (goethite) in the solid state by the following reaction:

$$2\ \alpha\text{-FeOOH} + 4\text{CaO} + 3\text{H}_2 \xrightarrow[150\text{–}300^\circ\ \text{C.}]{1\text{–}1000\ \text{atm}} 2\text{Fe} + 4\text{Ca(OH)}_2.$$

This reaction involves: (1) the dehydration of hydrous iron oxide, (2) the two, stepwise, endothermic reductions of the α-$Fe_2O_3$ and $Fe_3O_4$ intermediates, which have unfavorable equilibria, and (3) the gettering (removal of a gas) of by-product water by the calcium oxide, to give an overall exothermic process with a highly productive equilibrium which is additionally favored by increased hydrogen pressure, unlike most prior art processes. An important feature of the present process is the use of submicron acicular particles of α-FeOOH (goethite) as the starting material. As will be described in the paragraphs which follow, suitable particulate α-FeOOH can be prepared, for example, by hydrolysis of $FeCl_3$ or by oxidation of $Fe(OH)_2$. The latter method is preferred because of its superior reproducibility and because of the superior characteristics of the needle-like α-FeOOH product. Goethite readily produced herein for use in the invention process has a length of 0.1–1μ, a diameter of 0.005–0.05μ and a length to diameter ratio of at least 10:1. My attempts to reduce commercially available α- or γ-$Fe_2O_3$ or $Fe_3O_4$ (regardless of reaction conditions) with hydrogen in the presence of calcium oxide failed to produce a particulate acicular α-iron product having the characteristics exhibited by the product of this invention process.

Another important feature of this process is the direct intermixing of calcium oxide with the α-FeOOH. This is in direct contrast to the use of calcium oxide solely as a water sequestering agent, as is disclosed in the aforesaid U.S. Pat. No. 3,607,219 wherein separate crucibles containing the calcium oxide and the α-FeOOH are placed one on top of the other. Sufficient calcium oxide must be present to effectively separate the particles of α-FeOOH during the reduction (to maintain acicularity and to prevent inter-particle sintering). A 1:1 weight ratio of materials represents the minimum amount of calcium oxide that must be present. Weight ratios of greater than about 5:1 provide no additional advantage, involve a waste of calcium oxide, and complicate removal of the excess calcium oxide from the desired product.

The first step of the process is difficult but important. The manner in which the α-FeOOH is recovered from its preparation process determines the difficulty and length of time needed in effecting its dispersion with finely divided calcium oxide. If the α-FeOOH is dried directly, resin-like agglomerates may be obtained, which agglomerates are very difficult to disperse with the calcium oxide. It is preferred that the α-FeOOH be recovered in finely divided form by freeze drying or by flushing into an organic liquid carrier, such as acetone, from which the α-FeOOH is recovered by filtering and then dried. The α-FeOOH particles in such a finely divided form are easier to disperse with the calcium oxide. However, milling of the two materials for several days is still desirable to make sure that an intimate mixture is obtained. As already suggested, it is preferred that the calcium oxide also be in a finely divided particulate state. This is easily accomplished by premilling the calcium oxide for a short period of time, for example, for one hour.

The reduction of the α-FeOOH can be carried out in a vessel under a hydrogen atmosphere, at the temperature and pressure indicated above, until hydrogen uptake ceases, as indicated, for example, by a gas flow meter or by cessation of hydrogen pressure drop in the vessel. The particulate product of this reduction contains at least 75 weight % iron, that is, the total iron content of the product, as an oxide, free acicular α-iron metal or other iron compound, such as a ferrite or ferrate, is at least 75 weight %, preferably at least 80 weight %, more preferably at least 85 weight %. The amount of desired acicular α-iron metal in the product is at least about 25 weight %. By the process of this invention, products containing at least 50–70 weight % acicular α-iron metal readily can be prepared. With extra precautions to exclude oxygen during product recovery, even higher yields of α-iron metal can be obtained.

Products prepared by the process of this invention exhibit coercivities of greater than 800 oersteds, preferably greater than 900 oersteds. However, product coercivities of 1000–1200 oersteds can be obtained by the invention process, depending on the exact conditions employed and the nature of the goethite starting material. Whereas coercivity is a measure of α-iron particle acicularity in the product (processes which destroy acicularity providing products having low coercivities) magnetization characteristics are a measure of the α-iron content of the product. Thus, in general, reduction processes which are carried out rigorously provide products having a higher free iron content, with resultant high magnetization characteristics, but, as in many prior art processes, at the expense of a loss in acicularity, with resultant low coercivities. Correspondingly, processes which are carried out less rigorously may yield products having high coercivities, but inferior magnetization characteristics.

Products prepared by the process of this invention not only exhibit the aforesaid high coercivities but also high magnetization characteristics, such as saturation magnetization ($\sigma_s$) and residual (remanent) magnetization ($\sigma_r$) and high $\sigma_r/\sigma_s$ ratios. The products of this invention process exhibit $\sigma_s$ values of at least 110 electromagnetic units per gram, preferably at least 120 emu/g, more preferably at least 130 emu/g. Values for $\sigma_s$ as high as about 170 emu/g have been achieved by the process described herein. Similarly, products prepared by the process of this invention exhibit high values of $\sigma_r$, for example, at least 50, preferably at least 60, electromagnetic units per gram. Products having $\sigma_r$ values up to about 90 emu/g have been obtained by means of this invention. The ratio $\sigma_r/\sigma_s$ is a measure of the ability of the acicular α-iron to retain its magnetization. Products having $\sigma_r/\sigma_s$ ratios of 0.44–0.65, usually at least about 0.45, can be obtained by means of this invention.

The procedure for recovering the desired product, containing acicular α-iron metal particles, from the reaction mixture after reduction by the process of this invention is important to the magnetization properties of the particles. First of all, care should be taken to eliminate contact of the α-iron particles with oxygen, since oxygen will convert the free iron (pyrophoric) to an oxide, resulting in a decrease in the magnetization ($\sigma_s$ and $\sigma_r$). A preferred recovery procedure is to bleed-off the remaining hydrogen after the reaction mixture is cooled to about ambient temperature. Substantially pure water, for example, distilled or deionized water, preferably oxygen-free, can then be introduced into the reaction vessel, after which the product is removed from the vessel as a slurry. If desired, the operation can be carried out under an inert atmosphere, although this is not essential since the product is protected from the air by the water present (the rate of oxygen diffusion through the water is the controlling factor). Deactivation (oxidation) of the surface of the product is well known in the art ("passivation") and, if carried out carefully by known techniques, results in only minor loss of desirable properties of the product.

After removal of the reaction mixture from the aforesaid vessel, the excess calcium oxide and byproduct calcium hydroxide, preferably to a substantial degree, should be separated from the desired product since the presence of such compounds merely dilutes the desired iron-containing product. The separation can be effected by one skilled in the art using known techniques. A convenient technique involves adding an acid to dissolve these calcium compounds. Although hydrochloric acid or nitric acid can be used, use of an organic acid is preferred. An especially preferred organic acid is acetic acid. Moreover, this step preferably is carried out at below room temperature, for example, at about 0°–10° C. In an especially preferred procedure ice is first added to the slurry and then cold acetic acid is added. In any procedure involving the use of an acid, the acid should be added slowly, with effective mixing, so that the pH is not reduced substantially below 7.0 and so that the time that the pH is below 7.0 is held to a minimum, since acidic pH conditions may lead to dissolution of the desired product. After acid dissolution of the calcium compounds the product, containing α-iron particles, can be removed by an appropriate solids removal technique, such as by decanting or by filtering, and thoroughly washed with water. It is to be understood that the product need not be completely free of calcium to be useful for its intended purpose. The amount of calcium remaining on the α-iron particles appears to be dependent on the conditions used in the invention process and on the extent and nature of the recovery procedure.

As described above, including the calcium removal step, the invention process may be more particularly described as a process for preparing acicular α-iron particles, which process comprises:

(a) dispersing acicular particles of α-FeOOH intimately with CaO, the CaO/α-FeOOH weight ratio being at least 1:1, the particles of α-FeOOH having a length of 0.1–1μ, a diameter of 0.005–0.05μ and a length to diameter ratio of at least 10:1;

(b) contacting the resultant dispersion with hydrogen at 150°–350° C. and 1–1000 atmospheres pressure until substantial uptake of hydrogen by the dispersion ceases;

(c) removing CaO and $Ca(OH)_2$ from the reaction mixture from (b); and (d) recovering particulate product containing at least 75 weight % iron (total iron content) and at least 25 weight % acicular α-iron metal, said particulate product having a length less than 1μ, a length to diameter ratio of at least 10:1, a coercivity ($iH_c$) of greater than 800 oersteds, a saturation magnetization ($\sigma_s$) of at least 110 emu/g, a residual magnetization ($\sigma_r$) of at least 50 emu/g and a ratio of $\sigma_r/\sigma_s$ of at least about 0.45.

As already suggested above, passivation can be effected by controlled diffusion of air (oxygen) through the water used in the aforesaid slurry and/or aqueous washing. Another convenient method to effect passivation is to replace the water on the aforesaid water-wet product with a water-miscible organic solvent, for example, acetone, and thereafter allow air (oxygen) to diffuse through the acetone to deactivate the surface of the acicular α-iron. After passivation has been completed, the product can be dried completely by conventional removal of all remaining liquid, for example, water or acetone. Still another method which can be used to effect passivation is to maintain the product under an inert atmosphere, such as a dry nitrogen atmosphere, until drying has been completed, and thereafter passing over the dried product an inert gas containing a small amount of air (oxygen) until passivation is complete, for example, by passing nitrogen containing 1% oxygen over the product for about 72 hours.

Magnetization properties of the acicular α-iron particles are not impaired and may be improved by the presence of some cobalt and/or nickel, for example, up to about 10 weight % of the total iron content of the product of the process of the invention. If desired an appropriate compound of cobalt and/or nickel can be admixed with the goethite prior to the hydrogen reduction step.

To prepare a magnetic recording medium the submicron particulate product described above, containing acicular α-iron metal particles, preferably unpassivated and maintained under an inert atmosphere, is uniformly and thoroughly dispersed in a binder material, such as a solution of an organic polymer, and the resultant dispersion is coated onto a non-magnetizable support, such as a thin high-strength film or a highly polished metal disc. A typical substrate is a tensilized polyester film. Techniques and conditions for preparing magnetic recording media are well known to those skilled in the art, as exemplified by the aforesaid U.S. Pat. No. 3,865,627.

The invention is further illustrated by the following examples in which parts and percentages are by weight unless otherwise indicated and temperatures are in degrees Celsius. The magnetic properties of α-Fe powders prepared herein were measured by a conventional ballistic magnetometer using a rod specimen and calibrated with nickel. The hysteresis loop is described by the standard three points: the saturation magnetization $\sigma_s$, the residual magnetization $\sigma_r$ and the intrinsic coercivity $iH_c$. The saturation field used was 4400 Oe. See Ferromagnetism, Bozorth, R. M., Van Nostrand Company, Inc., N.Y., 1951, p. 2–5, p. 843–849. In all the examples and experiments, standard analytical procedures were followed to determine the total iron content and calcium content (where determined). The oxygen content is determined by difference from 100%. In calculations of α-Fe content, calcium is assumed to be present as $CaFe_2O_4$, the most expected compound. Oxygen, excluding that combined in $CaFe_2O_4$, is generally assumed to be present as $Fe_2O_3$ (from surface oxidation of α-Fe). The α-Fe content is calculated by difference from the total iron, subtracting the iron content of $CaFe_2O_4$ and $Fe_2O_3$.

The starting acicular α-FeOOH particles used in the examples was synthesized either by $FeCl_3$ hydrolysis or by $Fe(OH)_2$ oxidation. A description of these two synthesis methods follows:

A. Preparation of α-FeOOH by $FeCl_3$ Hydrolysis

In accordance with the equation:

$$2FeCl_3+3(NH_2)_2CO+7H_2O \rightarrow 2\text{-}FeOOH+6NH_4Cl+3CO_2$$

339 g of $FeCl_3.6H_2O$ and 112 g of urea (as pH control) were dissolved in 4 l. of deionized water and the resulting solution was filtered into a 5 l. spherical vessel equipped with heating jacket, stirrer and thermometer. With continuous rapid stirring, the solution was heated to 100°. A yellow precipitate appeared when the temperature reached 79° and the suspension exhibited streaming birefringence. After 8 hrs at 97°–100°, heating and stirring were stopped. The yellow solid product phase flocculated and settled out overnight. The clear supernatant was decanted and the sediment was diluted with water to 2 l. It peptized to a sol which was filtered through a coarse glass frit. Acetone was added to the aquasol to flocculate the solid phase which was sedimented out by centrifuging. The clear supernatant was decanted and the sediment was redispersed by stirring in acetone. The product was washed 3× with acetone. Approximately 80 g of α-FeOOH was obtained in the form of needle-like crystals of 0.05×0.5 μm as revealed by electron microscopy.

B. Preparation of α-FeOOH by $Fe(OH)_2$ Oxidation

Three solutions were prepared as follows:

1. 4,695 g of $FeSO_4.7H_2O$ in 76 lb (34.5 kg) of distilled water
2. 11,085 g of NaOH in 129 lb (58.5 kg) of distilled water.
3. 90.9 g of NaOCl in 1,819 g of 5% aqueous NaOCl solution, diluted with 900 ml of distilled water.

Solution 2, cooled to room temperature, was added as rapidly as possible to freshly prepared and vigorously stirred solution 1. To the resulting slurry of $Fe(OH)_2$, solution 3 was added dropwise with stirring over a period of about 1 hr to nucleate growth of α-FeOOH crystallites. The nucleated slurry was then oxidized by passing air at a rate of 6 l./min through stainless steel gas dispersion tubes into the well-stirred slurry. This aeration was conducted for 20 hrs. although the reaction appeared complete in approximately 4 hrs. The product was recovered by filtering through a 5 frame filter press employing polypropylene filter cloth and washing with distilled water until the washings were $SO_4^{--}$-free and had a pH=7. The product was freeze-dried, followed by vacuum drying at room temperature. The product weighed 1,482 g and comprised yellow needle-like crystallites approximately 0.015×0.4–0.6 μm as revealed by electron microscopy.

EXAMPLE 1

An acetone suspension of approximately 20 g of α-FeOOH, prepared by $FeCl_3$ hydrolysis (method A), was diluted with acetonitrile to 600 ml and the suspension was boiled to distill off acetone, leaving the α-FeOOH dispersed in acetonitrile. To this dispersion having a volume of 200 ml was added premilled calcined CaO (80 g) and 100 ml of acetonitrile and the slurry was stirred vigorously during the solvent evaporation under $N_2$ flow to a thick paste. The latter was dried overnight in a vacuum oven at 100°–120°. The dried mixture of α-FeOOH and CaO was placed in a stainless steel cup which was enclosed in a pressure vessel; the vessel was evacuated and filled with $H_2$ to about 500 atm pressure. A temperature-graduated reduction program to control nucleation and growth of α-Fe crystals was conducted as follows:

5 hrs/175°/850 atm $H_2$
5 hrs/200°/900 atm $H_2$
5 hrs/225°/930 atm $H_2$
10 hrs/250°/1000 atm $H_2$.

The reactor was cooled under pressure, then bled and evacuated. Water was admitted through the gas inlet before the vessel was opened. The product was removed as a slurry and 160 ml of glacial acetic acid were added to the slurry with ice cooling to remove excess CaO and by-product $Ca(OH)_2$. The product was washed repeatedly with $H_2O$, then acetone, using magnetic decanting, that is, holding the product at the base of the vessel with a magnet while pouring off the liquid. After passivation (as described above: 1% oxygen in nitrogen for 72 hrs) the product was recovered (4.2 g); $iH_c$=991 oe, $\sigma_s$=112.9 emu/g, $\sigma_r$=58.0 emu/g, $\sigma_r/\sigma_s$=0.56, total Fe=77.39% and acicular α-Fe=24.73%. Although not measured by elemental analysis, a $Ca^{+2}$ concentration of about 0.2% was estimated by emission spectroscopy. The acicular α-iron content of the product was determined as follows:

(1) assuming all calcium is present as $CaFe_2O_4$: 1.08% $CaFe_2O_4$
(2) assuming all oxygen other than that in $CaFe_2O_4$ is present as $Fe_2O_3$: 73.5% $Fe_2O_3$
(3) assuming all iron other than that in $CaFe_2O_4$ and $Fe_2O_3$ is present as acicular α-iron: 24.73% acicular α-iron.

EXAMPLE 2

α-FeOOH (150 g), prepared by $Fe(OH)_2$ oxidation (method B above), and CaO (450 g) were mixed and mulled together under $N_2$ using a mortar and pestle. The mixture was then glass rod milled for 138 hrs, after which it was transferred from the mill to a pressure vessel for reduction by $H_2$ in accordance with the following time/temperature/pressure program:

3 hrs/175°/450 atm $H_2$
5 hrs/200°/500 atm $H_2$
10 hrs/225°/510 atm $H_2$
15 hrs/250°/525 atm $H_2$.

The reactor was cooled, the $H_2$ was bled off, the vessel was evacuated and 500 ml of water were admitted. The pressure vessel was opened and the contents were removed as a slurry, to which ice was added, then 900 ml of cold glacial acetic acid were added gradually with stirring and continued cooling. Additional acid was added as necessary to neutralize all of the $Ca(OH)_2$ and to adjust the pH of the suspension to about 6. The black slurry containing α-Fe was placed in a cylindrical vessel which fit between the opposing poles of a powerful magnet. The slurry was moved up and down in the magnetic field until the α-Fe-containing product magnetically flocculated and agglomerated. The supernatant liquid was decanted and discarded. Water was added to the product which was then dispersed by stirring and again magnetically agglomerated as above; the supernatant was decanted. This was repeated until all the water-soluble and nonmagnetic impurities were removed from the product. At this stage the water was replaced by acetone, employing repeated decantings with acetone to remove the water. The acetone suspension (that is, the product was not passivated) was assayed to show the following: 79 g of product comprising 90.37% total Fe, 69.60% acicular α-Fe, $iH_c$=970 oe, $\sigma_s$=159.5 emu/g, $\sigma_r$=80.9 emu/g and $\sigma_r/\sigma_s$=0.51. Although not measured by elemental analysis, a $Ca^{+2}$ concentration of about 0.5% was estimated by emission spectroscopy. The acicular α-iron content was determined as in Example 1. In connection therewith it was calculated that the product contained 2.69% $CaFe_2O_4$ and 27.71% $Fe_2O_3$.

EXAMPLES 3–43

The essential details of Example 2 were repeated in a series of examples, the exact conditions being varied within the limits set forth above. Characteristics of the unpassivated products thus obtained are summarized in the following table.

| Ex. No. | % Fe (total) | $iH_c$, oe | $\sigma_s$, emu/g | $\sigma_r$, emu/g | $\sigma_r/\sigma_s$ |
|---|---|---|---|---|---|
| 3 | 86.75 | 930 | 128.9 | 60.4 | 0.47 |
| 4 | 86.97 | 1004 | 128.9 | 83.5 | 0.65 |
| 5 | 88.73 | 992 | 149.1 | 79.9 | 0.54 |
| 6 | 87.80 | 989 | 139.8 | 73.3 | 0.52 |
| 7 | 88.88 | 1080 | 159.0 | 87.2 | 0.55 |
| 8 | 88.10 | 980 | 152.3 | 79.5 | 0.52 |
| 9 | 88.07 | 979 | 135.9 | 71.2 | 0.52 |
| 10 | 88.31 | 1100 | 153.0 | 84.1 | 0.55 |
| 11 | 88.62 | 1070 | 148.3 | 80.4 | 0.54 |
| 12 | 83.48 | 941 | 142.7 | 68.5 | 0.48 |
| 13 | 83.19 | 959 | 130.3 | 62.3 | 0.48 |
| 14 | 81.09 | 1060 | 126.0 | 59.8 | 0.47 |
| 15 | 86.08 | 1060 | 134.0 | 69.3 | 0.52 |
| | 72.75 | | | | |
| 16 | 73.63 | 995 | 124.2 | 59.7 | 0.48 |
| 17 | 85.90 | 1040 | 135.0 | 71.3 | 0.53 |
| 18 | 71.94 | 1030 | 100.5 | 49.1 | 0.49 |
| 19 | 75.80 | 856 | 88.4 | 39.0 | 0.44 |
| 20 | 84.74 | 995 | 143.7 | 74.6 | 0.52 |
| 21 | 56.51 | 1070 | 68.7 | 34.3 | 0.50 |
| 22 | 81.49 | 947 | 122.0 | 61.9 | 0.51 |
| 23 | 81.32 | 1070 | 139.5 | 75.5 | 0.54 |
| 24 | 84.78 | 1050 | 140.1 | 76.2 | 0.54 |
| 25 | 65.87 | 833 | 88.3 | 38.7 | 0.44 |
| 26 | 89.12 | 998 | 136.7 | 67.3 | 0.49 |
| 27 | 83.08 | 934 | 130.0 | 61.7 | 0.47 |
| 28 | 84.06 | 926 | 126.4 | 58.7 | 0.46 |
| 29 | 83.95 | 951 | 135.9 | 66.5 | 0.49 |
| 30 | 84.03 | 987 | 139.1 | 73.1 | 0.53 |
| 31 | 88.08 | 922 | 122.2 | 58.7 | 0.48 |
| 32 | 87.98 | 1000 | 145.7 | 74.9 | 0.51 |
| 33 | 75.61 | 804 | 121.3 | 62.7 | 0.52 |
| 34 | 86.42 | 900 | 153.6 | 76.3 | 0.50 |
| 35 | 84.95 | 972 | 130.2 | 65.4 | 0.50 |
| 36 | 84.81 | 923 | 168.4 | 86.1 | 0.51 |
| | | 963 | 105.4 | 60.3 | 0.57 |
| 37 | 86.32 | 950 | 145.5 | 72.9 | 0.50 |
| 38 | 88.81 | 972 | 144.7 | 69.8 | 0.48 |
| 39 | 83.75 | 955 | 133.3 | 67.4 | 0.51 |
| 40 | 78.95 | 925 | 93.6 | 49.8 | 0.53 |

-continued

| Ex. No. | % Fe (total) | $iH_c$, oe | $\sigma_s$, emu/g | $\sigma_r$, emu/g | $\sigma_r/\sigma_s$ |
|---|---|---|---|---|---|
| 41 | 79.17 | 936 | 105.7 | 58.0 | 0.55 |
| 42 | 86.96 | 1040 | 110.6 | 60.0 | 0.54 |
| 43 | 86.19 | 1170 | 138.9 | 78.2 | 0.56 |

It is to be understood that not all of Examples 3–43 are to be considered as truly representative of the invention process in that, in some instances (Examples 16, 18, 19, 21 and 25), problems were encountered either in carrying out the process or in analyzing the product of the process.

EXAMPLE 44

A. This example was carried out substantially in accordance with the procedure set forth in Example 2, except as noted below, for the purpose of establishing a control for comparison with Comparative Experiments 2 and 3. The same batch of α-FeOOH (freshly prepared by method B above) was used in this example and in Comparative Experiments 2 and 3.

Glass rod milling of the α-FeOOH (30 g) and CaO (90 g) was carried out for 4 hours. The hydrogen reduction program was as follows:

5 hours/175°/850 atm $H_2$
5 hours/200°/900 atm $H_2$
5 hours/225°/930 atm $H_2$
10 hours/250°/1000 atm $H_2$.

Assay of the unpassivated product provided the following results:

% iron (total): 82.44
% calcium (by elemental analysis): 3.45
% boron (by elemental analysis): <0.01
% oxygen (by difference): 14.11
% acicular α-iron: 52.83
$iH_c$ (oersteds): 1160
$\sigma_s$ (emu/g): 131.6
$\sigma_r$ (emu/g): 76.6
$\sigma_r/O_s$: 0.58.

The acicular α-iron content of the product was determined as follows:

(1) assuming all calcium is present as $CaFe_2O_4$: 18.59% $CaFe_2O_4$
(2) assuming all oxygen other than that in $CaFe_2O_4$ is present as $Fe_2O_3$: 28.61% $Fe_2O_3$
(3) assuming all iron other than that in $CaFe_2O_4$ and $Fe_2O_3$ is present as acicular α-iron: 52.83% acicular α-iron.

The X-ray diffraction analysis of the product showed a strong α-iron pattern.

B. As a forerunner to part A of this example the same procedure was carried out except that the product, covered with a water layer, inadvertently was exposed to the atmosphere for 72 hours before it was assayed, thus demonstrating one of the passivation techniques described above. Assay of the product provided the following results, the same assumptions being made as in part A:

% iron (total): 77.48
% calcium (by elemental analysis): 3.13
% boron (by elemental analysis): <0.01
% oxygen (by difference): 19.39
% acicular α-iron: 35.30
$iH_c$ (oersteds): 1190
$\sigma_s$ (emu/g): 115

$\sigma_r$ (emu/g): 67.3
$\sigma_r/\sigma_s$: 0.59
% $CaFe_2O_4$: 16.87
% $Fe_2O_3$: 47.88.

COMPARATIVE EXPERIMENTS

The following experiments were carried out to demonstrate critical features of the invention process. The results of the three experiments which follow and a comparison thereof with the results of Examples 1, 2 and 44 are shown in the table following the experiments.

EXPERIMENT 1

In this experiment the criticality of intimate dispersal of the CaO with the α-FeOOH is illustrated. In U.S. Pat. No. 3,607,219 (cited above) which teaches the use of CaO as a water-binding agent in the reduction of γ-$Fe_2O_3$ with hydrogen, two crucibles, one containing the γ-$Fe_2O_3$ and the other CaO, are placed one on top of the other in an autoclave. The autoclave, after flushing with $H_2$, is filled to the desired pressure with $H_2$ and then heated to 300° C. under a pressure of 1–100 atmospheres.

In the instant experiment aliquots of the same α-FeOOH and CaO used in Example 2 were used and the reduction program was the same. The high pressure reactor was divided into two concentric cylinders by means of a cylinder of 100 mesh stainless steel screen. In Control A, the α-FeOOH was placed in the core cylinder and surrounded by CaO. In Control B, the positions of the reactants were then interchanged. The following table shows the magnetic properties of the two products obtained.

| | Product Characteristics | | | |
|---|---|---|---|---|
| | % Fe (total) | $iH_c$, oe | $\sigma_s$, emu/g | $\sigma_r$, emu/g |
| Control A | 86.02 | 489 | 146.8 | 65.2 |
| Control B | 90.51 | 574 | 142.9 | 62.7 |

The product of the invention process exhibits superior properties, particularly a higher coercivity, exceeding that of the acicular α-Fe particles prepared by this prior art method by a magnitude of almost 2.

EXPERIMENT 2

Example 1 of U.S. Pat. No. 4,050,902 (cited above) reads as follows:

"100 g of α-FeOOH needles of length 0.5/μ and 30:1 length:thickness ratio are dispersed in 2 liters of methanol. 2.9 g of barium acetate, dissolved in 30 ccs of water, are added. After evaporating off the solvent, the oxide power [sic] is dried at 100° C. under reduced pressure. Reduction with hydrogen at 300° C. for 8 hours gives an acicular iron powder."

In this experiment the procedures which were employed followed the essential details of said Example 1 except that the barium acetate was replaced by an equivalent amount of calcium acetate and except that the product was not passivated prior to assay so as to ensure that the magnetic characteristics of the product were maintained at their highest level between the time of preparation and the time of assay. The assay results for the product are shown in the following table.

Product Characteristics

% iron (total): 76.35
% acicular α-iron: 18.03
% calcium (elemental anal.): 0.88
$iH_c$ (oersteds): 600
$\sigma_s$ (emu/g): 102.9
$\sigma_r$ (emu/g): 51.3
$\sigma_r/\sigma_s$: 0.50.

The acicular α-iron content of the product was determined as follows:

(1) assuming all calcium is present as $CaFe_2O_4$: 4.74% $CaFe_2O_4$
(2) assuming all oxygen other than that in $CaFe_2O_4$ is present not as $Fe_2O_3$ but as $Fe_3O_4$ (confirmed by strong X-ray diffraction pattern for $Fe_3O_4$): 77.23% $Fe_3O_4$
(3) assuming all iron other than that in $CaFe_2O_4$ and $Fe_3O_4$ is present as acicular α-iron: 18.03% acicular α-iron
(4) assuming all oxygen other than that in $CaFe_2O_4$ is present as $Fe_2O_3$ (unlikely in view of X-ray diffraction pattern): 71.07% $Fe_2O_3$
(5) assuming all iron other than that in $CaFe_2O_4$ and $Fe_2O_3$ is present as acicular α-iron: 24.24% acicular α-iron.

EXPERIMENT 3

Example 44A was repeated except that only 10 weight % of CaO, based on the weight of α-FeOOH, was used. This is the maximum amount of the calcium, barium or strontium cation and of the carboxylic acid disclosed in U.S. Pat. No. 4,050,962 (cited above). The results obtained are shown in the table below.

Product Characteristics

% iron (total): 72.07
% acicular α-iron: 7.62
% calcium (elemental anal.): 0.15
$iH_c$ (oersteds): 203
$\sigma_s$ (emu/g): 50.5
$\sigma_r$ (emu/g): 17.6
$\sigma_r/\sigma_s$: 0.35.

The following table provides a ready comparison of the results achieved in Examples 1, 2 and 44 and Comparative Experiments 1, 2 and 3. The data reflect the assumpions set forth above regarding calculation of the acicular α-iron content. Moreover, it should be kept in mind that the assayed products of Examples 1 and 44B were passivated.

| | Ex. 1 | Ex. 2 | Ex. 44A | Ex. 44B |
|---|---|---|---|---|
| % iron (total) | 77.39 | 90.37 | 82.44 | 77.48 |
| % acicular α-iron | 24.73 | 69.60 | 52.83 | 35.30 |
| $iH_c$ (oersteds) | 991 | 970 | 1160 | 1190 |
| $\sigma_s$ | 112.9 | 159.5 | 131.6 | 115 |
| $\sigma_r$ | 58.0 | 80.9 | 76.6 | 67.3 |
| $\sigma_r/\sigma_s$ | 0.56 | 0.51 | 0.58 | 0.59 |
| % calcium | about 0.2 | about 0.5 | 3.45 | 3.13 |
| % boron | — | — | <0.01 | <0.01 |
| % oxygen | — | — | 14.11 | 19.39 |
| % $CaFe_2O_4$ | 1.08 | 2.69 | 18.59 | 16.87 |
| % $Fe_2O_3$ | 73.5 | 27.71 | 28.61 | 47.88 |
| % $Fe_3O_4$ | — | — | — | — |

| | Expt. 1 | | | |
|---|---|---|---|---|
| | A | B | Expt. 2 | Expt. 3 |
| % iron (total) | 86.02 | 90.51 | 76.35 | 72.07 |
| % acicular α-iron | — | — | 18.03* | 7.62 |

-continued

| | | | | |
|---|---|---|---|---|
| $iH_c$ (oersteds) | 489 | 574 | 600 | 203 |
| $\sigma_s$ | 146.8 | 142.9 | 102.9 | 50.5 |
| $\sigma_r$ | 65.2 | 62.7 | 51.3 | 17.6 |
| $\sigma_r/\sigma_s$ | 0.44 | 0.44 | 0.50 | 0.35 |
| % calcium | — | — | 0.88 | 0.15 |
| % boron | — | — | — | — |
| % oxygen | — | — | 22.77 | 27.78 |
| % $CaFe_2O_4$ | — | — | 4.74 | 0.81 |
| % $Fe_2O_3$ | — | — | —* | 91.63 |
| % $Fe_3O_4$ | — | — | 77.23* | — |

*See Comparative Example 2 discussion

INDUSTRIAL APPLICABILITY

The primary use for the high coercivity α-Fe particles prepared by the process of the present invention is in coatings for magnetic recording tapes. There follows a description of the preparation of magnetic tape using the α-Fe-containing product prepared in Example 17.

α-Fe-containing product (15 g) from Example 17 was dispersed in a mixture of 1.05 g of oleic acid dispersant, 11.6 g of polyurethane binder solution containing 17% polyurethane in tetrahydrofuran, 0.4 g of a lubricant comprising Armid® (a mixture of palmitamide and stearamide) and butyl stearate, and 22 g of tetrahydrofuran by shaking with 50 g of sand (passing sieve No. 150 and retained on sieve No. 230, U.S. Sieve Series) in a Spex® mill for 30 minutes. The mixture was then cooled, 0.94 g of triisocyanate curing agent (RC 805) was added, and the mixture was shaken for 5 minutes. The dispersion was pressure filtered through a 1 cm bed of 150/230 mesh sand supported on a ⅛" (3.175 mm) nylon felt pad and coated on a 1 mil (0.0254 mm) Mylar® polyester base using a 0.002" (0.0508 mm) doctor knife. The freshly coated film was passed through a coaxial orienting field, dried as rapidly as possible, and calendered to improve surface smoothness. The final magnetic tape coating contained 35 vol % α-Fe and had the following properties: $\sigma_r/\sigma_s=0.82$, $iH_c=997$ oe, retentivity $(B_r)=3871$ gauss.

Using other products prepared by the process of this invention tapes having $B_r$ values in the range 3000–5000 gauss were readily produced. Tapes produced from products prepared by this invention process are comparable in properties to the high quality tapes described by Feldman, Popular Science, November, 1978, page 99.

The following table is provided to show a correlation between $\sigma_s$ values of acicular materials commercially used in the production of magnetic tapes and $B_r$ values of the tapes produced therewith.

| | $\sigma_s$ | $B_r$ |
|---|---|---|
| $Fe_2O_3$ or $Fe_3O_4$ | 60–80 | 1200 |
| Cobalt - doped $Fe_2O_3$ | 75–80 | 1600–2000 |

-continued

| | $\sigma_s$ | $B_r$ |
|---|---|---|
| $CrO_2$ | 75–80 | 1600–2000 |
| Fe | ≧110 | 3400 |

It is to be understood that the scope of the present invention does not limit the use of the α-iron particles to magnetic tapes. As the high coercivity of these α-iron particles is a measure of their resistance to demagnetization (magnetic "hardness"), they are particularly useful in permanent magnets for electrical and electronic devices. Being particulate and acicular, the α-iron-containing product readily lends itself to fabrication of powerful permanent magnets by aligning the particles in a magnetic field, cold pressing, and either sintering them by well known powder metallurgy techniques or binding them by means of adhesive organic or inorganic polymeric materials. The very small particle size of the product of this invention makes it useful as a magnetic filler in plastics to be extruded for gasketing, magnetic door closures and fasteners, for display devices, and for toys. It is also useful as a pigment in printing inks for information recording.

BEST MODE FOR CARRYING OUT THE INVENTION

The best mode for carrying out the invention is best demonstrated herein by Example 2.

I claim:

1. Particulate product containing at least 75 weight % iron (total iron content) and at least 25 weight % acicular α-iron metal, said particulate product having a length less than 1μ, a length to diameter ratio of at least 10:1, a coercivity ($iH_c$) of greater than 800 oersteds, a saturation magnetization ($\sigma_s$) of at least 110 emu/g, a residual magnetization ($\sigma_r$) of at least 50 emu/g and a ratio of $\sigma_r/\sigma_s$ of at least about 0.45.

2. Product of claim 11 which contains at least 80 weight % iron (total iron content), has an $iH_c$ of greater than 900 oersteds, a $\sigma_s$ of at least 120 emu/g and a $\sigma_r$ of at least 60 emu/g.

3. Product of claim 2 which contains at least 85 weight % iron (total iron content) and at least 50–70 weight % acicular α-iron metal and has an $iH_c$ of 1000–1200 oersteds and a $\sigma_s$ of at least 130 emu/g.

4. Magnetic recording medium comprising a magnetizable layer carried on a nonmagnetizable support, the magnetizable layer comprising a non-magnetizable organic polymeric binder material having uniformly dispersed therein finely divided acicular ferromagnetic particles, said recording medium characterized in that the ferromagnetic particles are comprised of the particulate product of claim 1.

5. Magnetic recording medium of claim 4 wherein the ferromagnetic particles are comprised of the particulate product of claim 3.

* * * * *

UNITED STATES PATENT OFFICE
CERTIFICATE OF CORRECTION

PATENT NO. : 4,273,807

DATED : June 16, 1981

INVENTOR(S) : Kenneth L. Berry

It is certified that error appears in the above-identified patent and that said Letters Patent are hereby corrected as shown below:

Column 14, line 39, Claim 2, "11" should be -- 1 --.

Signed and Sealed this

*Tenth* Day of *November 1981*

[SEAL]

*Attest:*

GERALD J. MOSSINGHOFF

*Attesting Officer*

*Commissioner of Patents and Trademarks*